United States Patent [19]

Fernandez

[11] 3,977,057

[45] Aug. 31, 1976

[54] APPARATUS FOR THE PRODUCTION OF YARN

[75] Inventor: Miguel A. Fernandez, Greenville, S.C.

[73] Assignee: Phillips Petroleum Company, Bartlesville, Okla.

[22] Filed: Jan. 6, 1975

[21] Appl. No.: 538,939

[52] U.S. Cl. ..... 28/1.6

[51] Int. Cl.[2] ..... D02G 1/12

[58] Field of Search ..... 28/1.6, 1.7, 72.14

[56] References Cited

UNITED STATES PATENTS 3,153,837 10/1964 Schippers et al. ..... 28/1.7

3,778,872 12/1973 Newton ..... 28/1.6

*Primary Examiner*—Louis K. Rimrodt

[57] ABSTRACT

In the production of yarn wherein a yarn plug is formed and stacked members positioned in a chamber are used to exert a restraining force on the yarn plug as the plug is passed through the chamber, a lid is used to prevent the removal of the stacked members from the chamber.

8 Claims, 2 Drawing Figures

APPARATUS FOR THE PRODUCTION OF YARN

BACKGROUND OF THE INVENTION

The invention relates to apparatus for the production of yarn.

Synthetic fibers are commonly produced by extruding molten polymer through a spinneret. In order to produce yarns which have properties approximating those of wool or other natural materials, it is common practice to subject the extrudate from the spinneret to a texturing process. This can be accomplished by a variety of procedures known in the art, such as stuffer-box crimping, false twisting, and fluid jet texturing. One particularly effective procedure involves contacting the yarn to be textured with a high velocity fluid in a first turbulent zone. Subsequently, the yarn and the fluid are passed to an enlarged zone and then to a zone where the yarn is restrained and cooled. In the restraining zone individual stacked members, such as balls, are used to exert a force on the yarn to restrain the yarn, which is in the form of a yarn wad. The fluid escapes from the yarn through the voids between the stacked members and a textured yarn is removed from the restraining zone. Although this procedure produces a high quality textured yarn, a particularly troublesome problem involves loss of the stacked members from the restraining zone. Sudden disruption during the normal operation of the texturing process frequently cause the stacked members to be thrown from the restraining zone; however, most of the stacked members are ejected from the restraining zone when the yarn wad is not visible above the surface of the stacked members, and this latter situation most often occurs during string-up of the processing line.

It is important to prevent removal of the stacked members from the restraining zone because the height of the stacked members in the restraining zone is an important parameter of yarn quality. Further, recovering the stacked members from the floor and/or replacing them with new ones involves considerable expense, particularly where a number of such processing lines are used.

Although it would appear such a problem could be easily solved, this has not bee the case. In order for the stacked members to function properly, they must be free to act upon the yarn wad and, in addition, the restraining zone containing the stacked members must be designed to allow the operator to easily string up and maintain the equipment. It has been very difficult to satisfy both of these conditions simultaneously. However, the present invention achieves such a result.

An object of the invention is to eliminate the loss of stacked members from a restraining zone.

Another object of the invention is to eliminate the loss of stacked members from a restraining zone and to allow an operator to easily string up and maintain the equipment.

Other aspects, objects, and advantages of the invention will be apparent to those skilled in the art upon studying the drawings, specification, and the appended claims.

SUMMARY OF THE INVENTION

In accordance with the invention, an apparatus for the production of yarn comprises a chamber having an inlet and an outlet; a plurality of stacked member positioned in the chamber; a lid covering the outlet of the chamber, the lid having an inner surface and an outer surface; and a first conduit means extending outwardly from the outer surface of the lid, the conduit means having an inlet and an outlet, the inlet being attached to approximately the center of the outer surface of the lid and in open communication with the chamber.

DETAILED DESCRIPTION OF THE INVENTION

Figures 1, 2:
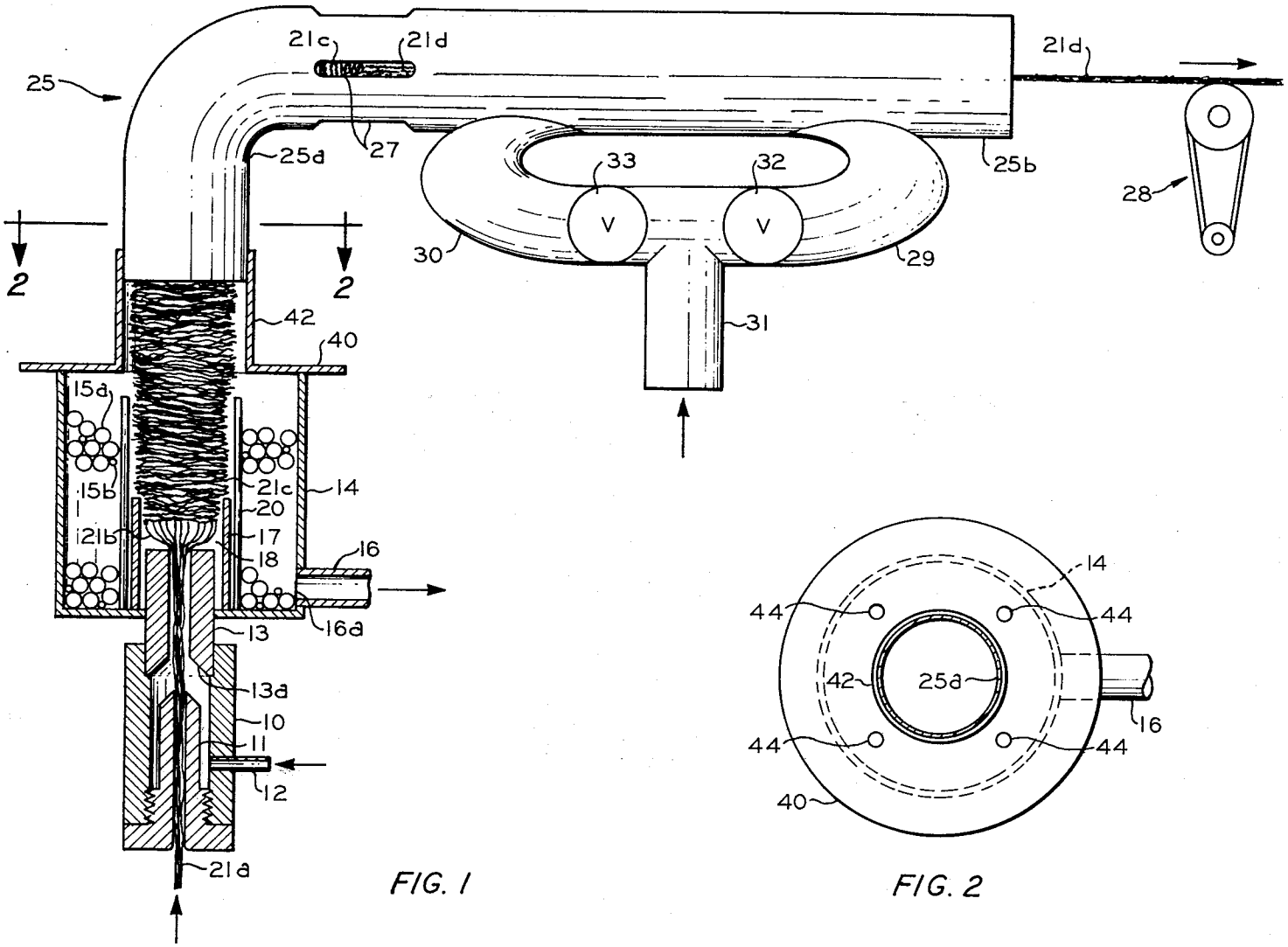
FIG. 1 illustrates an embodiment of the apparatus of this invention in conjunction with a fluid jet and a quench tube which are employed to texture a yarn.
FIG. 2 is a plan view of the embodiment of the invention of FIG. 1 taken along line 2—2 in FIG. 1.

Referring now to the drawing in detail and to FIG. 1 in particular, there is shown a housing 10 which has a hollow needle 11 positioned therein. A conduit 12 communicates with housing 10 to introduce a fluid, such as steam or air, at an elevated temperature. A tube 13 is secured to housing 10 so that the opening therethrough forms an extension of the passage through needle 11. The inlet end of the tube 13 is tapered to provide a seat 13*a* adjacent the end of needle 11. The angle of seat 13*a* can be the same as the angle of the tapered end of needle 11, but this is not necessary.

A hollow chamber 14 is secured to the tube 13 to enclose the upper end of the tube. A large number of relatively small balls 15*a* and 15*b* are disposed within chamber 14. Chamber 14 can be provided with an outlet conduit 16 which is connected to a drain or to a source of reduced pressure, not shown. A screen 16*a* is positioned across conduit 16 to retain balls 15*a* and 15*b* within chamber 14. A sleeve 17 encloses tube 13 within chamber 14 and extends upwardly above the tube to form a zone 18 of high turbulence. Four rods 20, spaced approximately 90° apart, surround sleeve 17 and extend upwardly through chamber 14.

A quench tube 25 having inlet portion 25*a* and outlet portion 25*b* is positioned above chamber 14. Use of a quench tube to break up a yarn plug and cool a heated textured yarn is well known in the art. In the illustrated embodiment of this invention, a lid 40 rests on the outlet end of chamber 14, and a conduit 42 is attached to the outer surface of lid 40 and slidably connected to the inlet portion 25*a* of quench tube 25. The diameter of conduit 42 is slightly larger than the diameter of inlet portion 25*a;* however, it is possible to make conduit 42 so that it slides inside the inlet portion 25*a* of quench tube 25 if desired.

Outlet portion 25*b* is provided with a plurality of slits 27. Yarn 21*d* is removed through the end of outlet portion 25*b* by means of a suitable takeup device 28 and is passed to a storage area, not shown. A conduit 29 communicates with quench tube 25 in a direction so that fluid passed through conduit 29 flows through tube 25 toward the end of inlet portion 25*a*. A second conduit 30 communicates with quench tube 25 in a direction so that fluid passed through this conduit flows through tube 25 toward the end of outlet portion 25*b*. Conduits 29 and 30 are connected to a common inlet conduit 31. Valves 32 and 33 are disposed in respective conduits 29 and 30.

In the operation of the apparatus, one or more filaments 21*a* are inserted through the interior passage of needle 11 into tube 13. These filaments can be delivered to the apparatus by any suitable feed means, not shown. In operation of the apparatus, the filaments are threaded completely through the apparatus. Fluid is introduced through conduit 12 and flows upwardly through tube 13 into zone 18. The fluid so introduced surrounds needle 11 to elevate the temperature of the incoming filaments. The velocity of the introduced fluid is sufficiently high to produce considerable turbulence in the passage defined by zone 18. The filaments are crimped to produce textured yarn 21*b*. The yarn passes upwardly to form an elongated generally cylindrical wad 21*c* in the region between rods 20. The wad in this region is engaged by balls 15*a* and 15*b* which exert a restraining force. Rods 20 confine the yarn wad to the central region of chamber 14. It is important that rods 20 be spaced a sufficient distance from one another that balls 15*a* and 15*b* are free to move therebetween to exert a force on the yarn wad. While four rods have been found to be satisfactory to retain the wad, more can be used if desired. In some operations, three rods spaced 120° apart will provide the desired support. The rods 20 are useful to prevent the yarn wad from collapsing or bending under the surface of the balls. Use of the rods is not always necessary, but such use is preferred.

If desired, an external heater can be employed to assist in elevating the temperature of the filaments in needle 11. The texturing fluid escapes from zone 18 and the yarn wad through the surrounding balls. When steam is employed as the texturing fluid, it may be desirable to provide vent conduit 16 to remove vapor and any condensate which may be formed. Balls 15*a* and 15*b* can be formed of metal, glass or any other material which is inert to the yarn at the temperature encountered. The balls are advantageously of spherical configuration, but this is not essential to the operation of the invention. As illustrated, balls 15*a* are larger than balls 15*b* to provide better packing. However, the balls can all be the same size. The height of the balls in chamber 14 should be sufficient to permit the yarn to be cooled by a substantial amount before removal from the chamber. In general, the upper surface of the balls should be at least one diameter of balls 15*a* below the tops of rods 20.

Valve 32 is opened and valve 33 is closed so that fluid, such as air, entering through conduit 31 flows through conduit 29, tube 25 toward the end of inlet portion 25*a*, conduit 42, into chamber 14 and out through apertures 44. A substantial quantity of this fluid also is vented through openings 27. The outlet portion 25*b* of quench tube 25 is open which results in some atmospheric air being drawn into the outlet end of the tube by aspiration. The yarn wad 21*c* rises through lid 40, conduit 42 and the inlet section of the tube 25 to a region in the vicinity of openings 27. At this point, the yarn wad tends to be broken up so that the individual textured strands 21*d* are passed through the remainder of tube 25. The flow of air through tube 25 serves to cool the yarn to assist in imparting a permanent crimp. In order to accomplish this result, it is desirable that openings 27 be positioned at a spaced location from the entrance of inlet portion 25*a*. This provides greater cooling before the yarn wad is broken up. During startup operation, valve 32 is closed and valve 33 is opened so that flow through the tubing is in the opposite direction. This provides an aspirating effect which tends to withdraw the yarn through the tubing.

Stringup of the apparatus of FIG. 1 is accomplished by passing a fluid through conduit 12 which flows upwardly through tube 13 into zone 18, aspirating one or more filaments 21*c* through the interior passage of needle 11 into tube 13. As yarn wad 21*c* forms, it pushes balls 15*a* and 15*b* from zone 18, and the yarn wad 21*c* continues to extend past the surface of balls 15*a* and 15*b* through conduit 42 into the inlet of quench tube 25 to the point where conduit 30 is connected to quench tube 25. At this point yarn wad 21*c* is blown through the end of outlet portion 25*b* and partially broken up. Yarn 21*d* is passed to the takeup device 28 and on to the storage area (not shown). During stringup valve 32 is closed and valve 33 is open to permit the cooling fluid to pass through conduits 31 and 30 which tends to aspirate the yarn wad 21*c*. Apertures 44 in lid 40 are important to permit sufficient room air to enter the inlet to inlet portion 25*a* of quench tube 25 for this aspiration.

The lid 40, according to the invention, prevents the ejection of balls 15*a* and 15*b* from chamber 14 as the end of yarn wad 21*c* surges through the balls during stringup. It is during this phase of the stringup operation that the greatest number of balls are ejected in absence of lid 40. Of course, lid 40 must be in the operating position during stringup to accomplish this purpose, but little difficulty has been encountered with the lid 40 in operating position during stringup. Also, rods 20 help to guide the yarn wad 21*c* into conduit 42. Further, the lid 40 prevents the balls 15*a* and 15*b* from escaping from chamber 14 during operation of the texturing apparatus. The cylindrical wad 21*c* usually surges or pulsates to some degree during the operation of the apparatus which in turn would cause some of the balls 15*a* and 15*b* to be thrown from chamber 14 if lid 40 were not used. In addition, lid 40 still permits the balls to freely act upon wad 21*c*.

Lid 40 and conduit 42 are constructed and installed such that lid 40 can be lifted by sliding conduit 42 over the portion 25*a* of tube 25 to permit easy access to chamber 14 of the texturizing apparatus. At least one aperture 44, shown in FIG. 2, is provided in lid 40 to permit escape of the fluid used in texturizing the yarn along with outlet conduit 16, to permit escape of the cooling fluid along with openings 27 in tube 25, and to permit entrance of aspirating air as previously described.

Normally, the weight of the lid is sufficient to overcome any forces imparted to the stacked members and thus to prevent removal of the stacked members from the chamber; however, it is within the scope of the invention to provide retention means to prevent the lid from rising off the outlet of chamber 14. Such retention means can be a spring forcing the lid against the chamber or a latch to fasten the lid to the chamber; however, the lid has been used without difficulty in absence of such retention means, and such devices would possibly increase problems for the operator during stringup.

Further retention means could be used to maintain the lid in the access position, that is, to hold the lid up off chamber 14. One example of such a device is a set screw fastened to the upper portion of conduit 42 which could be tightened against quench tube 25. Obviously, this type of device could be used to maintain the lid in either the operating or the access position, but such a device is not recommended because an operator can inadvertently leave the lid in the access position after the apparatus is in operation.

Among the advantages of the invention is that the stacked members are not confined and will function properly on the yarn wad. In addition, the inventive device used to prevent escape of the stacked members is easily removed or lifted away, permitting the operator easy access to chamber 14 of processing line without costly down time. This lifting or removing can be accomplished with one hand which leaves the operator with one hand free to hold and use an aspirator or other tools. Thus the present invention has proven to be an excellent solution to the problem of loss of stacked members without interposing additional problems. The lid is inexpensive to construct and install and it is easy to use.

In a specific example, a lid was made from 3/32 inch thick aluminum plate having a diameter of 4 inches with 8 perforation ¼ inch diameter 45° apart on a 1¼ inches radius. The tube welded to the top was 1½ inches OD tubing 6 inches long with ⅛ inch wall thickness. The lid was used on a yarn processing line having a 3½ inch OD chamber containing a mixture of ⅛ inch and ¼ inch diameter steel balls and slidably affixed to the quench tube essentially as schematically shown in FIG. 1. The yarn processing line operated satisfactorily without loss of balls. Also, it is pointed out that the apertures in the lid were of greater diameter than the diameter of some of the balls; however, this did not appear to cause any difficulty.

Any type of synthetic fiber which can be textured by the application of external forces at elevated temperatures can be treated by the process of this invention. Typical fibers which can be so treated are polyolefins, nylons and polyesters, for example.

What is claimed is:

1. Apparatus for the production of yarn comprising:

a chamber in which a yarn wad is formed, said chamber having an inlet and an outlet;

a plurality of stacked members positioned in said chamber, around said yarn and a distance below the outlet of said chamber;

a lid of fixed operating position but removable for string up covering the outlet of said chamber, said lid having an inner surface and an outer surface; and said inner surface positioned a distance above said stacked members;

first conduit means extending outwardly from the outer surface of said lid, said conduit means having an inlet and an outlet, said inlet being attached to approximately the center of the outer surface of said lid and in open communication with said chamber.

2. The apparatus of claim 1 further comprising a quench tube having an inlet and an outlet wherein said first conduit is slidably connected to the inlet of said quench tube and the inlet of said quench tube is positioned a distance outwardly from said lid.

3. The apparatus of claim 2 further comprising textured yarn takeup means spaced from the outlet of said quench tube to remove textured yarn from a wad of yarn formed in said chamber.

4. The apparatus of claim 1 wherein said lid contains at least one perforation.

5. The apparatus of claim 1 wherein the stacked members are balls.

6. The apparatus of claim 1 further comprising:

means forming a first passage through which yarn to be textured can be directed, said first passage having an inlet and an outlet for the yarn;

means forming a second passage of greater cross-sectional area at the outlet thereof than at the inlet, the inlet of said second passage being connected to the outlet of said first passage;

second conduit means communicating with the inlet of said first passage to introduce a fluid; and wherein the inlet of said chamber is connected to the outlet of said second passage.

7. The apparatus of claim 6 wherein said first passage is cylindrical and said second passage is of truncated conical configuration.

8. The apparatus of claim 7 further comprising a vent communicating with said chamber to remove condensate formed within said chamber.

* * * * *

UNITED STATES PATENT OFFICE

CERTIFICATE OF CORRECTION

PATENT NO. : 3,977,057

DATED : Aug. 31, 1976

INVENTOR(S) : Miguel A. Fernandez

It is certified that error appears in the above-identified patent and that said Letters Patent are hereby corrected as shown below:

Column 5, line 38, "yarn and" should read -- yarn wad and --.

Signed and Sealed this

Sixteenth Day of November 1976

[SEAL]

*Attest:*

RUTH C. MASON
*Attesting Officer*

C. MARSHALL DANN
*Commissioner of Patents and Trademarks*